US011131080B2

(12) United States Patent
Aoki et al.

(10) Patent No.: US 11,131,080 B2
(45) Date of Patent: Sep. 28, 2021

(54) HYDRAULIC CIRCUIT OF CONSTRUCTION MACHINE

(71) Applicants: KAWASAKI JUKOGYO KABUSHIKI KAISHA, Kobe (JP); CATERPILLAR SARL, Geneva (CH)

(72) Inventors: Seiji Aoki, Kobe (JP); Yoshiyuki Tode, Kakogawa (JP); Masahiro Ohira, Kobe (JP); Hideki Nakajima, Akashi (JP)

(73) Assignees: KAWASAKI JUKOGYO KABUSHIKI KAISHA, Kobe (JP); CATERPILLAR SARL, Geneva (CH)

( * ) Notice: Subject to any disclaimer, the term of this patent is extended or adjusted under 35 U.S.C. 154(b) by 0 days.

(21) Appl. No.: 17/262,838

(22) PCT Filed: Aug. 1, 2019

(86) PCT No.: PCT/JP2019/030113

§ 371 (c)(1),
(2) Date: Jan. 25, 2021

(87) PCT Pub. No.: WO2020/031816

PCT Pub. Date: Feb. 13, 2020

(65) Prior Publication Data

US 2021/0140144 A1 May 13, 2021

(30) Foreign Application Priority Data

Aug. 10, 2018 (JP) ..... JP2018-151071

(51) Int. Cl.
*E02F 9/22* (2006.01)
*F15B 11/16* (2006.01)

(52) U.S. Cl.
CPC ..... *E02F 9/2278* (2013.01); *E02F 9/2267* (2013.01); *E02F 9/2225* (2013.01); *F15B 11/16* (2013.01); *F15B 2211/30535* (2013.01); *F15B 2211/6313* (2013.01)

(58) Field of Classification Search
CPC ..... B62D 5/075; F15B 11/165; F15B 2211/6313; F15B 13/026; E02F 9/2225
See application file for complete search history.

(56) References Cited

U.S. PATENT DOCUMENTS

2017/0274930 A1* 9/2017 Zhang ..... E02F 9/2203

FOREIGN PATENT DOCUMENTS

JP H07-076861 A 3/1995

* cited by examiner

*Primary Examiner* — Abiy Teka
(74) *Attorney, Agent, or Firm* — Oliff PLC

(57) ABSTRACT

A hydraulic circuit of a construction machine includes: a first pump line that connects a delivery port of a pump to a pump port of a first direction-switching valve; a second pump line that is branched off from the first pump line and is connected to a pump port of a second direction-switching valve; and a priority valve provided on the second pump line. The priority valve is configured to: fully open the second pump line when a pressure difference between a delivery pressure of the pump and a load pressure of a first actuator is greater than a setting value; and decrease an opening degree of the second pump line in accordance with decrease in the pressure difference when the pressure difference is less than the setting value.

2 Claims, 2 Drawing Sheets

HYDRAULIC CIRCUIT OF CONSTRUCTION MACHINE

TECHNICAL FIELD

The present invention relates to a hydraulic circuit installed in a construction machine.

BACKGROUND ART

In construction machines, it is common that both a travel actuator and a work equipment actuator are hydraulic actuators. In the case of a small-sized construction machine, a hydraulic circuit in which a single pump serves as a source of pressurized oil to be supplied to both the actuators, i.e., a hydraulic circuit of a "single-pump system", may be installed. In the single-pump system, in a case where both a traveling operation and a work equipment operation are performed in parallel concurrently, it is possible that the delivery flow rate of the pump becomes insufficient for a required flow rate, and consequently, both the traveling speed and the moving speed of the work equipment may become insufficient.

In this respect, Patent Literature 1 indicates an arm as one example of work equipment, and indicates an arm cylinder as one example of a hydraulic actuator that moves the work equipment. In Patent Literature 1, a single-pump system includes: a travel direction-switching valve that moves in accordance with a traveling operation; an arm direction-switching valve that moves in accordance with an arm operation; a travel pressure compensation valve that controls an upstream/downstream pressure difference of the travel direction-switching valve; and an arm pressure compensation valve that controls an upstream/downstream pressure difference of the arm direction-switching valve.

The system is further provided with a control pressure outputter that outputs control pressures to the travel pressure compensation valve and the arm pressure compensation valve based on a travel load pressure and an arm load pressure when both operations are performed in parallel. Due to the function of the control pressure outputter, the degree of restriction of the pressure compensation valve on a relatively low load side increases, and the flow rate passing through the direction-switching valve on a relatively high load side increases. The control pressure outputter is constituted by a plurality of solenoid valves corresponding to the plurality of pressure compensation valves, respectively.

CITATION LIST

Patent Literature

PTL 1: Japanese Laid-Open Patent Application Publication No. H07-76861

SUMMARY OF INVENTION

Technical Problem

In the above-described system, when both operations are performed in parallel, it may be possible to suppress decrease in the speed of a relatively high-load actuator. However, the system requires the plurality of pressure compensation valves and the plurality of solenoid valves, and also requires a group of complex oil passages for supplying control pressures to the respective pressure compensation valves. In addition, it is necessary to construct a solenoid valve control routine that is adapted to various operation patterns. Thus, both hardware and software configurations of the system are complex, and as a result, the cost of the system is high.

In view of the above, an object of the present invention is to simplify the configuration of a single-pump system that is capable of, even when operations to move a plurality of different actuators in the single-pump system are performed concurrently, suppressing decrease in the moving speed of each actuator.

Solution to Problem

A hydraulic circuit of a work vehicle according to the present invention includes: a first actuator; a second actuator; a pump; a first direction-switching valve including a pump port and a pair of supply/discharge ports connected the first actuator, the first direction-switching valve connecting the pump port to one of the supply/discharge ports when an operation to move the first actuator is performed; a second direction-switching valve including a pump port and a pair of supply/discharge ports connected to the second actuator, the second direction-switching valve connecting the pump port to one of the supply/discharge ports when an operation to move the second actuator is performed; a first pump line that connects a delivery port of the pump to the pump port of the first direction-switching valve; a second pump line that connects the delivery port of the pump to the pump port of the second direction-switching valve; and a priority valve provided on the second pump line. The priority valve is configured to: fully open the second pump line when a pressure difference between a delivery pressure of the pump and a load pressure of the first actuator is greater than a setting value; and decrease an opening degree of the second pump line in accordance with decrease in the pressure difference when the pressure difference is less than the setting value.

According to the above configuration, in a case where operations to move the first actuator and the second actuator in a single-pump system are performed concurrently, when the load pressure of the first actuator is high, the opening degree of the second actuator is restricted. This makes it possible to secure a flow rate supplied to the first actuator and suppress decrease in the moving speed of the first actuator, regardless of the state of the second actuator. Unlike the conventional art, the above configuration does not require a large number of valves, and the adoption of the above configuration makes it possible to suppress decrease in the moving speed of the first actuator with a simple system configuration.

Advantageous Effects of Invention

The present invention makes it possible to simplify the configuration of a single-pump system that is capable of, even when operations to move different types of first and second actuators in the single-pump system are performed concurrently, suppressing decrease in the moving speed of the first actuator regardless of the state of the second actuator.

DESCRIPTION OF EMBODIMENTS

Figure 1:
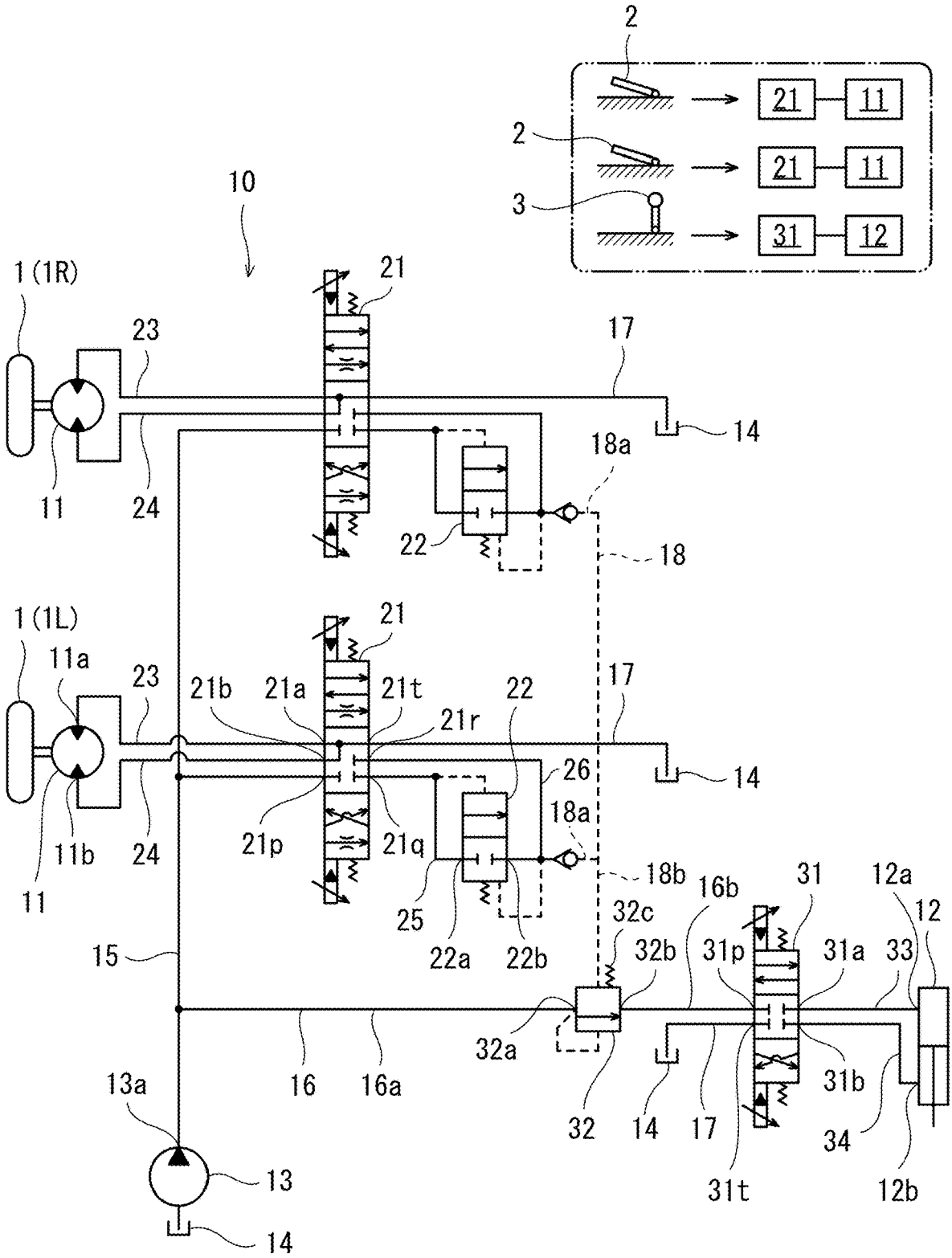
FIG. 1 is a circuit diagram showing a hydraulic circuit according to an embodiment.

FIG. 1 is a circuit diagram showing a hydraulic circuit 10 according to an embodiment. The hydraulic circuit 10 shown in FIG. 1 is installed in a construction machine (in particular, a small-sized construction machine). Although not illustrated in detail, the construction machine includes work equipment mounted to its body frame, and the work equipment is operated to perform required work. The construction machine is a self-propelled crawler vehicle including a pair of left and right crawlers. Examples of such a construction machine include an excavator and a crane truck.

The hydraulic circuit 10 includes one or more first actuators 11 and one or more second actuators 12. Alternatively, the hydraulic circuit 10 drives one or more first actuators 11 and one or more second actuators 12 provided in the construction machine. FIG. 1 shows only one second actuator 12 for simplifying the drawing. Each of the actuators 11 and 12 is a hydraulic actuator.

The construction machine includes an operator cab that is provided with one or more first operation devices 2 and one or more second operation devices 3 operated by an operator. The one or more first operation devices 2 correspond to the one or more first actuators 11, respectively. When one of the first operation devices 2 is operated, a corresponding one of the first actuators 11 moves in a moving direction corresponding to the operating direction. The same relationship applies between the one or more second operation devices 3 and the one or more second actuators 12.

As merely one example, each first actuator 11 is a travel actuator, and each second actuator 12 is a work equipment actuator.

In such a case, the one or more first actuators 11 include: a left travel motor 11L, which drives a left drive sprocket 1L included in a left crawler; and a right travel motor 11R, which drives a right drive sprocket 1R included in a right crawler. Each first actuator 11 is a hydraulic motor that is rotatable bi-directionally (in a forward travel direction and a backward travel direction). Each first actuator 11 includes a pair of supply/discharge ports 11*a* and 11*b*.

In a case where the construction machine is an excavator, the one or more second actuators 12 include, for example, a slewing motor that slews the work equipment together with the operator cab, an arm cylinder that drives an arm of the work equipment, and a bucket cylinder that drives a bucket of the work equipment. As one example of the second actuator 12, FIG. 1 shows a double-acting hydraulic cylinder including two supply/discharge ports 12*a* and 12*b*.

The one or more first operation devices 2 include a left travel operation device 2L and a right travel operation device 2R. The left travel operation device 2L causes the left travel motor 11L, i.e., the left drive sprocket 1L, to rotate in the forward travel direction or the backward travel direction. The right travel operation device 2R causes the right travel motor 11R, i.e., the right drive sprocket 1R, to rotate in the forward travel direction or the backward travel direction. For example, the first operation devices 2, which are travel operation devices, are pedal-type operation devices, whereas the second operation devices 3, which are work equipment operation devices, are lever-type operation devices. This allows the operator to operate the first operation devices 2 and the second operation devices 3 concurrently by using his/her hands and feet.

The construction machine may be mounted with a controller provided for the hydraulic circuit 10 (in other words, the construction machine may be mounted with a hydraulic system that includes the hydraulic circuit 10 and the controller provided therefor). The controller may electronically control the actions of hydraulic components included in the hydraulic circuit 10 in accordance with outputs from sensors that detect operating amounts and/or operating directions of the operation devices 2 and 3.

The hydraulic circuit 10 includes a pump 13, a tank 14, a first pump line 15, a second pump line 16, a tank line 17, one or more first direction-switching valves 21, one or more pressure compensation valves 22, one or more pairs of first supply/discharge lines 23 and 24, one or more second direction-switching valves 31, a priority valve 32, and one or more pairs of second supply/discharge lines 33 and 34.

The pump 13 sucks hydraulic oil stored in the tank 14, and delivers the pressurized oil from a delivery port 13*a*. The pump 13 is the source of supply of the pressurized oil to the actuators 11 and 12.

One first direction-switching valve 21, one pressure compensation valve 22, one pair of first supply/discharge lines 23 and 24, and one first actuator 11 constitute one module. In each module, the first direction-switching valve 21 includes a pump port 21*p* and a pair of supply/discharge ports 21*a* and 21*b*. The pump port 21*p* is connected to the delivery port 13*a* of the pump 13 via the first pump line 15. The supply/discharge port 21*a* is connected to the supply/discharge port 11*a* of the corresponding first actuator 11 via the supply/discharge line 23, and the supply/discharge port 21*b* is connected to the supply/discharge port 11*b* of the corresponding first actuator 11 via the supply/discharge line 24. The first direction-switching valve 21 further includes a tank port 21*t*, and the tank port 21*t* is connected to the tank 14 via the tank line 17 (the same applies to another tank port, which will be described below).

When an operation to move the first actuator 11 is performed, the pump port 21*p* is connected to one of the supply/discharge ports 21*a* and 21*b*. The definition of the term "connect" herein includes not only port-to-port communication inside the first direction-switching valve 21, but also a connection established via an oil passage outside the first direction-switching valve 21.

In this respect, in the present embodiment, the first direction-switching valve 21 further includes a primary port 21*q* and a secondary port 21*r*. In each module, the primary port 21*q* of the first direction-switching valve 21 is connected to a primary port 22*a* of the corresponding pressure compensation valve 22 via a primary compensation line 25 disposed outside the first direction-switching valve 21. A secondary port 22*b* of the pressure compensation valve 22 is connected to the secondary port 21*r* of the corresponding first direction-switching valve 21 via a secondary compensation line 26 disposed outside the first direction-switching valve 21. When an operation to move the first actuator 11 is performed, the pump port 21*p* communicates with the primary port 21*q* inside the first direction-switching valve 21 regardless of the operating direction. The secondary port 21*r* communicates with one of the supply/discharge ports 21*a* and 21*b* inside the first direction-switching valve 21 in accordance with the operating direction. The pump port 21*p* is connected to one of the supply/discharge ports 21*a* and 21*b* via the primary port 21*q*, the corresponding primary compensation line 25, the corresponding pressure compensation valve 22, the corresponding secondary compensation line 26, and the secondary port 21*r*.

The second pump line 16 is branched off from the first pump line 15. The priority valve 32 is provided on the second pump line 16. The second pump line 16 includes an upstream portion 16*a* and a downstream portion 16*b*. The upstream portion 16*a* connects the first pump line 15 to an inlet port 32*a* of the priority valve 32, and the downstream portion 16*b* is connected to an outlet port 32*b* of the priority valve 32.

One second direction-switching valve 31, one pair of second supply/discharge lines 33 and 34, and one second actuator 12 constitute one module. In each module, the second direction-switching valve 31 includes a pump port 31*p* and a pair of supply/discharge ports 31*a* and 31*b*. The pump port 31*p* is connected to the outlet port 32*b* of the priority valve 32 via the downstream portion 16*b* of the second pump line 16. In other words, the second pump line 16 is branched off from the first pump line 15, and is connected to the pump port 31*p* of the second direction-switching valve 31. The supply/discharge port 31*a* is connected to the supply/discharge port 12*a* of the second actuator 12 via the second supply/discharge line 33, and the supply/discharge port 31*b* is connected to the supply/discharge port 12*b* of the second actuator 12 via the second supply/discharge line 34. In a case where the second actuator 12 is a double-acting hydraulic cylinder, a poppet may be interposed in one of the supply/discharge lines 33 and 34, the one supply/discharge line 33 or 34 being connected to the rod-side oil chamber of the second actuator 12, and also, a line through which the hydraulic oil flows reversely from the tank 14 may be connected to the one supply/discharge line 33 or 34 connected to the rod-side oil chamber of the second actuator 12.

The priority valve 32 is configured to fully open the second pump line 16 when the pressure difference between the delivery pressure of the pump 13 and the load pressure of the first actuator 11 is greater than a setting value. Further, the priority valve 32 is configured to decrease the opening degree of the second pump line 16 in accordance with decrease in the pressure difference when the pressure difference is less than the setting value. The term "pressure difference" herein means a pressure value that is obtained by subtracting the load pressure of the first actuator 11 from the delivery pressure of the pump 13. Briefly speaking, when the load pressure of the first actuator 11 increases, the second pump line 16 is restricted by the function of the priority valve 32.

In the present embodiment, the priority valve 32 exerting the above-described functions is mechanically and hydraulically configured, and electronic control is involved as less as possible to move the priority valve 32. For example, the priority valve 32 includes a valve body and a spring 32*c*. The valve body changes the opening degree of the second pump line 16. The spring 32*c* urges the valve body in the closing direction. The "setting value" herein is adjusted by spring force exerted by the spring 32*c*. The hydraulic pressure of the hydraulic oil flowing through the upstream portion 16*a* of the second pump line 16 (i.e., the delivery pressure of the pump 13) is applied to the valve body in the opening direction. On the other hand, the load pressure of the first actuator 11 is applied to the valve body in the closing direction. In order to supply the load pressure to the priority valve 32, the priority valve 32 is connected to the secondary compensation line 26 via a signal pressure supply line 18. The signal pressure supply line 18 is branched off from the secondary compensation line 26, and is connected to the priority valve 32. Accordingly, the hydraulic pressure of the hydraulic oil flowing through the secondary compensation line 26 is supplied to the priority valve 32 as the load pressure of the first actuator 11. In a case where a plurality of the first actuators 11 are present, the signal pressure supply line 18 includes a plurality of branch portions 18*a* and a shared portion 18*b*. The plurality of branch portions 18*a* extend from the plurality of secondary compensation lines 26, respectively. The plurality of branch portions 18*a* merge together to form the single-line shared portion 18*b*, which is connected to the priority valve 32. It is illustrated in the drawing that the second pump line 16 is closed when the priority valve 32 is in a neutral state (i.e., when the pump 13 is in a stopped state). However, this is merely one example. Alternatively, the second pump line 16 may be open with a small opening degree when the priority valve 32 is in a neutral state.

Hereinafter, actions of the hydraulic circuit 10 configured as above are described. The first direction-switching valve 21 is a three-position direction-switching valve. The first direction-switching valve 21 changes its valve position in accordance with an operation of the first operation device 2 to switch the communication state of the ports (i.e., switch the function). The switching may be performed by using a control pressure or by using electronic control (the same applies to the second direction-switching valve 31).

When the first operation device 2 is in a non-operated state, the first direction-switching valve 21 is positioned in its neutral position (see the middle function in FIG. 1). When the first direction-switching valve 21 is in the neutral position, each of the pair of supply/discharge ports 21*a* and 21*b* is connected to the tank port 21*t*, and the remaining three ports 21*p*, 21*q*, and 21*r* are blocked. As a result, the supply of pressurized oil to the first actuator 11 stops; the first actuator 11 stops; and the drive sprocket 1 stops.

When the first operation device 2 is operated in a first direction, the first direction-switching valve 21 is positioned in a first position (see the upper function in FIG. 1). When the first direction-switching valve 21 is in the first position, the pump port 21*p* is connected to the primary port 21*q*; the secondary port 21*r* is connected to the supply/discharge port 21*b*; and the tank port 21*t* is connected to the supply/discharge port 21*a*. The pressurized oil from the pump 13 is supplied to the supply/discharge port 11*b* of the first actuator 11 via the pressure compensation valve 22. As one example, the drive sprocket 1 rotates in the forward travel direction (counterclockwise in a left side view) to move the vehicle forward.

When the first operation device 2 is operated in a second direction, the first direction-switching valve 21 is positioned in a second position (see the lower function in FIG. 1). When the first direction-switching valve 21 is in the second position, the pump port 21*p* is connected to the primary port 21*q*; the secondary port 21*r* is connected to the supply/discharge port 21*a*; and the tank port 21*t* is connected to the supply/discharge port 21*b*. The pressurized oil from the pump 13 is supplied to the supply/discharge port 11*a* of the first actuator 11 via the pressure compensation valve 22. As one example, the drive sprocket 1 rotates in the backward travel direction (clockwise in a left side view) to move the vehicle backward.

When the first operation device 2 is operated, the pump port 21*p* communicates with the primary port 21*q* regardless of the operating direction of the first operation device 2. The pressurized oil from the pump 13 is (after passing through the first direction-switching valve 21 once) inputted to the secondary port 21*r* of the first direction-switching valve 21 via the primary compensation line 25, the pressure compensation valve 22, and the secondary compensation line 26. Accordingly, the load pressure of the first actuator 11 (the hydraulic pressure in the secondary compensation line 26, the secondary pressure of the pressure compensation valve 22) is supplied to the priority valve 32. As a result, the supplied load pressure, in addition to the urging force of the spring, urges the valve body of the priority valve 32 in the closing direction.

On the other hand, when the first operation device 2 is in a non-operated state, no load pressure is supplied to the priority valve 32. The pressurized oil from the pump 13 is supplied to the upstream portion 16*a* of the second pump line 16. The hydraulic pressure of the hydraulic oil flowing through the upstream portion 16*a* (i.e., the delivery pressure of the pump 13) is applied to the valve body of the priority valve 32. The pressure difference between the delivery pressure of the pump 13 and the load pressure exceeds the setting value, which is adjusted by the spring force of the spring. As a result, the priority valve 32 is fully opened. The pressurized oil from the pump 13 is supplied to the second direction-switching valve 31 via the upstream portion 16*a*, the priority valve 32, and the downstream portion 16*b*.

The second direction-switching valve 31 is a three-position direction-switching valve. The second direction-switching valve 31 changes its valve position in accordance with an operation of the second operation device 3 to switch the communication state of the ports (i.e., switch the function).

When the second operation device 3 is in a non-operated state, the second direction-switching valve 31 is positioned in its middle position. When the second direction-switching valve 31 is in the middle position, four ports 31*a*, 31*b*, 31*p*, and 31*t* are blocked. The supply of pressurized oil to the second actuator 12 stops, and the second actuator 12 stops. When the second operation device 3 is operated in a first direction, the second direction-switching valve 31 is positioned in a first position (see the upper function in FIG. 1). When the second direction-switching valve 31 is in the first position, the pump port 31*p* is connected to the supply/discharge port 31*a*, and the tank port 31*t* is connected to the supply/discharge port 31*b*. The pressurized oil from the pump 13 is supplied to the supply/discharge port 12*a* of the second actuator 12, and the work equipment moves in one direction. When the second operation device 3 is operated in a second direction, the second direction-switching valve 31 is positioned in a second position (see the lower function in FIG. 1). When the second direction-switching valve 31 is in the second position, the pump port 31*p* is connected to the supply/discharge port 31*b*, and the tank port 31*t* is connected to the supply/discharge port 31*a*. The pressurized oil from the pump 13 is supplied to the supply/discharge port 12*b* of the second actuator 12, and the work equipment moves in the opposite direction to the one direction.

When the first operation device 2 and the second operation device 3 are operated concurrently, the valve position of each of the first direction-switching valve 21 and the second direction-switching valve 31 is switched from the neutral position. As a result of the valve position of the first direction-switching valve 21 being switched from the neutral position, the load pressure of the first actuator 11 is supplied to the priority valve 32 via the signal pressure supply line 18. In this example, the delivery pressure of the pump 13 is applied to the valve body of the priority valve 32 in the opening direction. Meanwhile, the spring force of the spring 32*c* and the load pressure of the first actuator 11 are applied to the valve body of the priority valve 32 in the closing direction. When the pressure difference between the delivery pressure of the pump 13 and the load pressure of the first actuator 11 is less than the setting value (which is adjusted by the spring force of the spring), the opening degree of the second pump line 16, which is defined by the position of the valve body, decreases.

Accordingly, a restriction amount by which the second pump line 16 is restricted, the restriction amount being set at the priority valve 32, increases in accordance with increase in the load of the first actuator 11. As a result, the flow rate flowing to the first direction-switching valve 21, i.e., the flow rate flowing to the first actuator 11, is secured preferentially. This makes it possible to suppress decrease in the moving speed of the first actuator 11, whose load is relatively high.

In the present embodiment, the first actuator 11 is a travel motor, and the second actuator 12 is a work equipment hydraulic actuator. When a traveling operation and a work equipment operation are performed concurrently, both the traveling speed and the moving speed of the work equipment can be suppressed from decreasing, and the traveling speed can be kept high.

As described above, in the single-pump system, when different types of actuators are moved, the moving speeds of both the actuators can be suppressed from decreasing. In the present embodiment, realization of such an advantage does not require electrical detection of the operating amount of the first operation device 2, the operating amount of the second operation device 3, the load pressure of the first actuator 11, and the load pressure of the second actuator 12. For this reason, it is not necessary to perform complex valve control that refers to the results of the detection of these parameters. Instead, one priority valve 32, which changes the opening degree of the second pump line 16, is provided on the second pump line 16, which is branched off from the first pump line 15, and also, the signal pressure supply line 18 is provided, which supplies the load pressure of the first actuator 11 as a control pressure to the priority valve 32. The adoption of this configuration makes it possible to simplify the configuration of the system that is capable of, when both operations are performed in parallel, suppressing decrease in the moving speeds of both the actuators.

Figure 2:
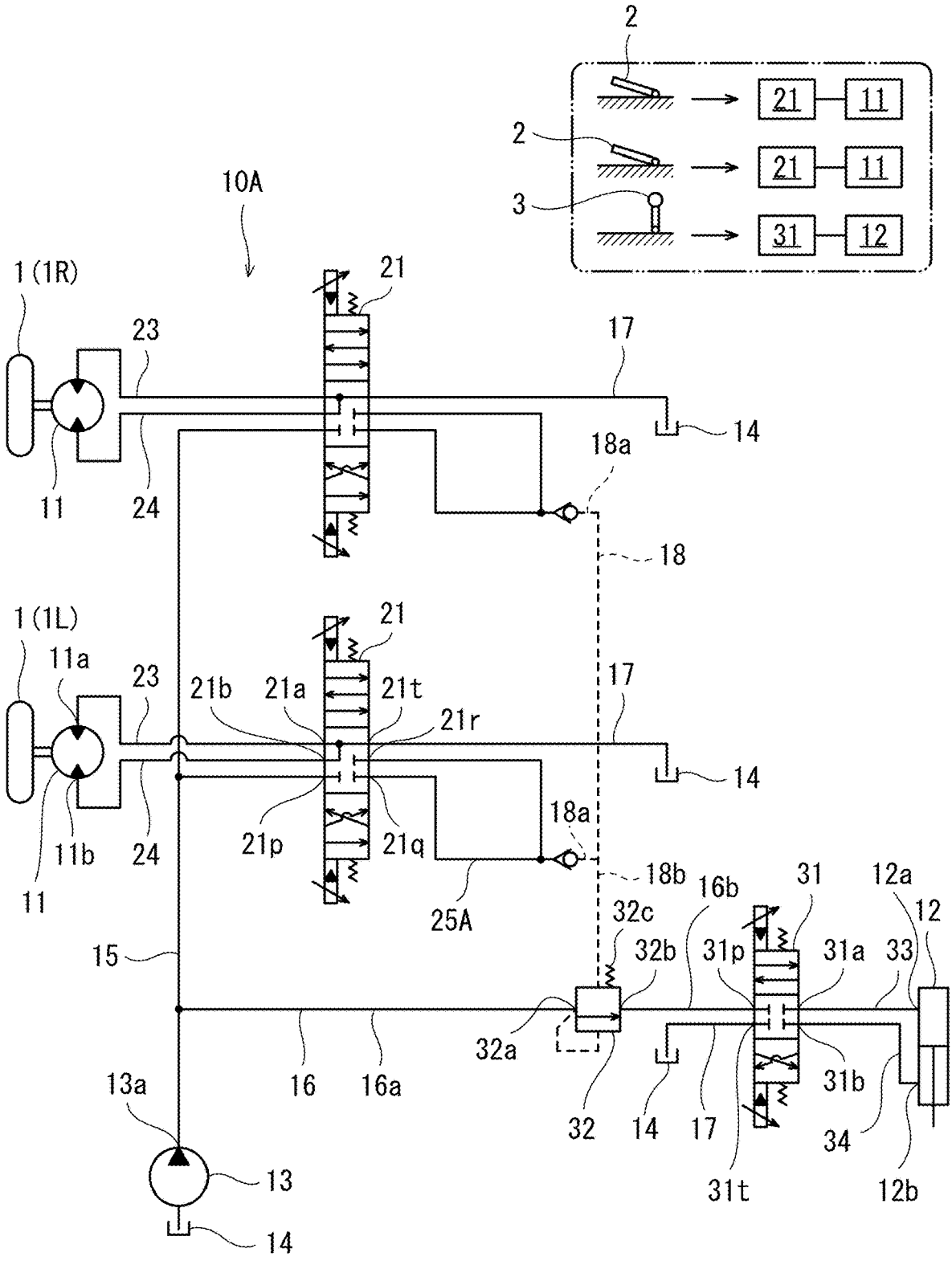
FIG. 2 is a circuit diagram showing a hydraulic circuit according to a variation.

Although the embodiment of the present invention has been described as above, the above-described configurations can be modified as necessary within the scope of the present invention. FIG. 2 shows a hydraulic circuit 10A according to a variation. As indicated in this variation, the pressure compensation valve 22 (see also FIG. 1) can be eliminated. In a case where the pressure compensation valve 22 is eliminated, as shown in the variation of FIG. 2, the structure of the first direction-switching valve 21 may be the same as that described in the above embodiment, or the structure may be modified. In a case where the structure of the first direction-switching valve 21 is the same as that described in the above embodiment, not the primary compensation line 25 and the secondary compensation line 26 (see also FIG. 1), but a connection oil passage 25A connects the primary port 21*q* to the secondary port 21*r*. The signal pressure supply line 18 is branched off from the connection oil passage 25A, and is connected to the priority valve 32. The hydraulic pressure of the hydraulic oil flowing through the connection oil passage 25A is supplied to the priority valve 32 as the load pressure of the first actuator (the travel motor). Also in this variation, when both operations are performed in parallel, both the traveling speed and the moving speed of the work equipment can be suppressed from decreasing, and the traveling speed can be kept high.

The first actuator may be a work equipment actuator, and the second actuator may be a travel actuator. In such a case, during both operations being performed in parallel, when the load pressure of the work equipment actuator is high, the flow rate to the work equipment actuator is secured preferentially, and the moving speed of the work equipment can be kept high.

REFERENCE SIGNS LIST

10 hydraulic circuit
11 first actuator

12 second actuator
13 pump
15 first pump line
16 second pump line
18 signal pressure supply line
21 first direction-switching valve
21*a*, 21*b* supply/discharge port
21*p* pump port
21*q* primary port
21*r* secondary port
22 pressure compensation valve
26 secondary compensation line
31 second direction-switching valve
31*a*, 31*b* supply/discharge port
31*p* pump port
32 priority valve

The invention claimed is:

1. A hydraulic circuit of a construction machine, comprising:

a first actuator;

a second actuator;

a pump;

a first direction-switching valve including a first pump port and a pair of first supply/discharge ports connected the first actuator, the first direction-switching valve connecting the first pump port to one of the first supply/discharge ports when an operation to move the first actuator is performed;

a second direction-switching valve including a second pump port and a pair of second supply/discharge ports connected to the second actuator, the second direction-switching valve connecting the second pump port to one of the second supply/discharge ports when an operation to move the second actuator is performed;

a first pump line that connects a delivery port of the pump to the first pump port of the first direction-switching valve;

a second pump line that connects the delivery port of the pump to the second pump port of the second direction-switching valve;

a priority valve provided on the second pump line; and a pressure compensation valve provided corresponding to the first actuator, wherein the priority valve is configured to:

fully open the second pump line when a pressure difference between a delivery pressure of the pump and a load pressure of the first actuator is greater than a setting value, and decrease an opening degree of the second pump line in accordance with decrease in the pressure difference when the pressure difference is less than the setting value;

the first direction-switching valve further includes:

a primary port connected to a primary side of the pressure compensation valve, and a secondary port connected to a secondary side of the pressure compensation valve via a secondary compensation line; and when an operation to move the first actuator is performed, the first pump port of the first direction-switching valve communicates with the primary port, and the secondary port communicates with one of the first supply/discharge ports of the first direction-switching valve, the first pump port is connected to the one of the first supply/discharge ports via the primary port, the pressure compensation valve, and the secondary port, the priority valve is connected to the secondary compensation line via a signal pressure supply line, and hydraulic pressure of hydraulic oil flowing through the secondary compensation line is supplied to the priority valve as the load pressure of the first actuator.

2. The hydraulic circuit of a construction machine according to claim 1, wherein the first actuator is a travel actuator, and the second actuator is an actuator for moving work equipment.

* * * * *